US007434873B2

(12) United States Patent
Baylor

(10) Patent No.: US 7,434,873 B2
(45) **Date of Patent: *Oct. 14, 2008**

(54) POP TOP TRAILER

(76) Inventor: Wesley Terran Baylor, 7215 Garden Grove Blvd., Unit C, Garden Grove, CA (US) 92841

( * ) Notice: Subject to any disclaimer, the term of this patent is extended or adjusted under 35 U.S.C. 154(b) by 2 days.

This patent is subject to a terminal disclaimer.

(21) Appl. No.: 11/650,128

(22) Filed: Jan. 5, 2007

(65) Prior Publication Data

US 2007/0157867 A1 Jul. 12, 2007

Related U.S. Application Data

(63) Continuation-in-part of application No. 11/109,522, filed on Apr. 19, 2005, now Pat. No. 7,159,531.

(51) Int. Cl.
*B60R 27/00* (2006.01)

(52) U.S. Cl. ..... 296/225; 114/361; 296/100.02; 296/171; 296/216.04

(58) Field of Classification Search ..... 114/361; 296/225, 100.2, 216.04, 222, 171, 173, 175
See application file for complete search history.

(56) References Cited

U.S. PATENT DOCUMENTS

| | | | | |
|---|---|---|---|---|
| 2,041,281 | A * | 5/1936 | Bishop | 296/224 |
| 3,519,306 | A * | 7/1970 | Young | 296/171 |
| 5,058,946 | A * | 10/1991 | Faber | 296/186.4 |
| 7,159,531 | B2 * | 1/2007 | Baylor | 114/361 |

* cited by examiner

*Primary Examiner*—Sherman Basinger
(74) *Attorney, Agent, or Firm*—Walter A. Hackler

(57) ABSTRACT

A vehicle includes a wheeled frame and sidewalls with a cockpit therein. A top is provided having a perimeter contoured for engaging a sidewall perimeter in a closed position and providing a canopy for the cargo/living space in an open position. Linear actuators are provided for moving the top between the open and closed positions along with a motor mechanism for operating the linear actuation. A panel moveably attached to the top enables operator entry and exit from the vehicle with the top in the closed position through an access provided by the panel.

6 Claims, 3 Drawing Sheets

FIG. 3.
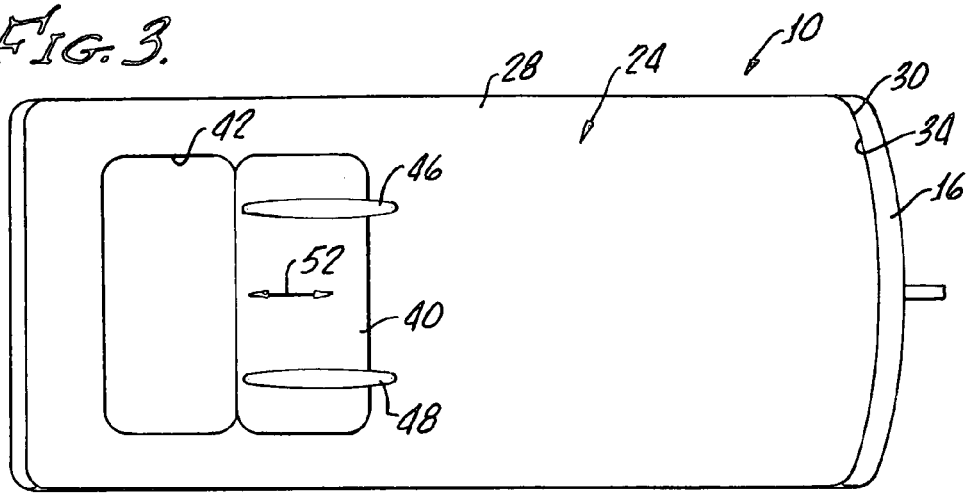
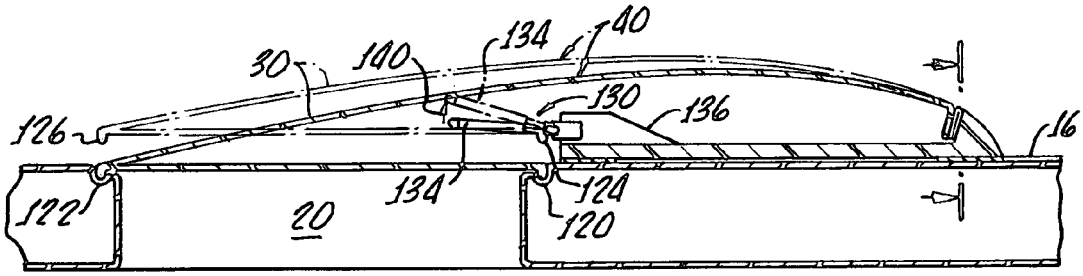
FIG. 7.
FIG. 8.
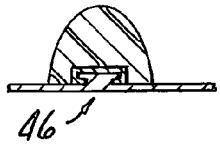
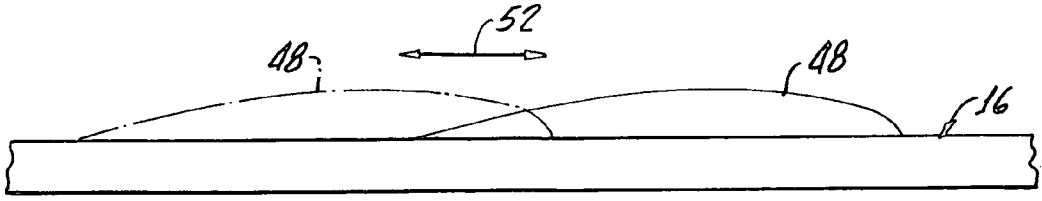
FIG. 9.

POP TOP TRAILER

This is a continuation-in-part of application Ser. No. 11/109,522 filed Apr. 19, 2005 and now U.S. Pat. No. 7,159,531.

The present invention is generally directed to vehicles and is more particularly directed to trailers and RVs with a moveable top, sometimes referred to as a "pop top", which enables closure upon lowering of the top while at the same time enabling entry and exit to the vehicle with the top in a closed position.

A great number of types of pop tops for vehicles have been designed and constructed. Vehicle canopies, or tops, which are rigid in nature have not proved practical heretofore due to the inherent lack of storage area for such tops on the vehicle, as well as the inconvenience and difficulty of installing and moving and storing the canopy, or top.

On the other hand, convertible soft type canopies have been utilized which may be either removable from the vehicle or folded in storage on the vehicle. However, such tops do not provide a secure vehicle with regard to both the environment and vandalism.

Even though a convertible top may be folded, it still occupies a considerable amount of space, of course, in a folded state provides no benefit to the boat operator.

The present invention provides for a moveable top which acts as a canopy when in an open position and a secure vehicle when in a closed position while at the same time enabling access to and from the vehicle when the canopy is in a closed position.

SUMMARY OF THE INVENTION

A vehicle in accordance with the present invention generally includes a vehicle frame along with sidewalls with a cargo/living space therebetween. A top is provided having a perimeter contoured for engaging a sidewall perimeter in a closed position and providing a canopy for the cargo/living space in an open position.

Linear actuators are provided for moving the top between the open and closed position along with a motor mechanism for operating the actuators.

Specifically, in accordance with the present invention, a panel may be provided and movably attached to the top for enabling operator entry and exit from the vehicle with the top in a closed position through an access provided by the panel.

In addition, the motor mechanism preferably includes a plurality of motors with each motor being disposed in an operative relationship within a corresponding linear actuator.

In order to provide a safety feature and prevent injury or damage during closure of the top against the sidewall, each actuator is attached to a corresponding sidewall with a compliant fixture for reducing pressure on any object disposed between the sidewall and the top during movement of the top to the closed position. More specifically, the compliant fixture may include a slotted bracket and each of the actuators includes a cross bar slidably retained in a corresponding slot.

A control system is provided for driving the motors and actuators in a manner which prevents torquing of the top. In that regard, the control system utilizes circuitry for monitoring the electrical current drawn by each of the motors and is responsive to unequal current draw for stopping operation in order to prevent unwanted torquing of the top which may cause damage thereto.

The present invention is also directed to the closure itself which may be utilized with a vehicle having a sidewalls with the closure including a movable top having a perimeter contoured for engaging the vehicle sidewalls for sealing the cargo/living space in a closed position and providing a canopy for the cargo/living space in an open position.

An actuator system is provided for moving the top between the open and closed position and a panel is movably attached to the top before enabling entry and exit from the vehicle with the top in a closed position through an access provided by the panel.

BRIEF DESCRIPTION OF THE DRAWINGS

The present invention may be more clearly understood with reference to the following detailed description in conjunction with the appended drawings, of which:

FIG. 3 is a top view of the vehicle and closure shown in FIGS. 1 and 2, more particularly showing a panel movably attached to the top for enabling entry and exit from the vehicle with the top in a closed position through an access provided by the panel;

FIG. 7 is a cross sectional view of the panel showing seals for closing the top and a lift mechanism for releasing a panel for sliding to an open position;

FIG. 8 is a cross sectional view taken along the line 8-8 of FIG. 7 illustrating a slide for the cover; and FIG. 9 is a diagram showing an open position exposing a cargo/living space and a closed position (dashed line) sealing the sidewalls.

DETAILED DESCRIPTION

Figure 1:
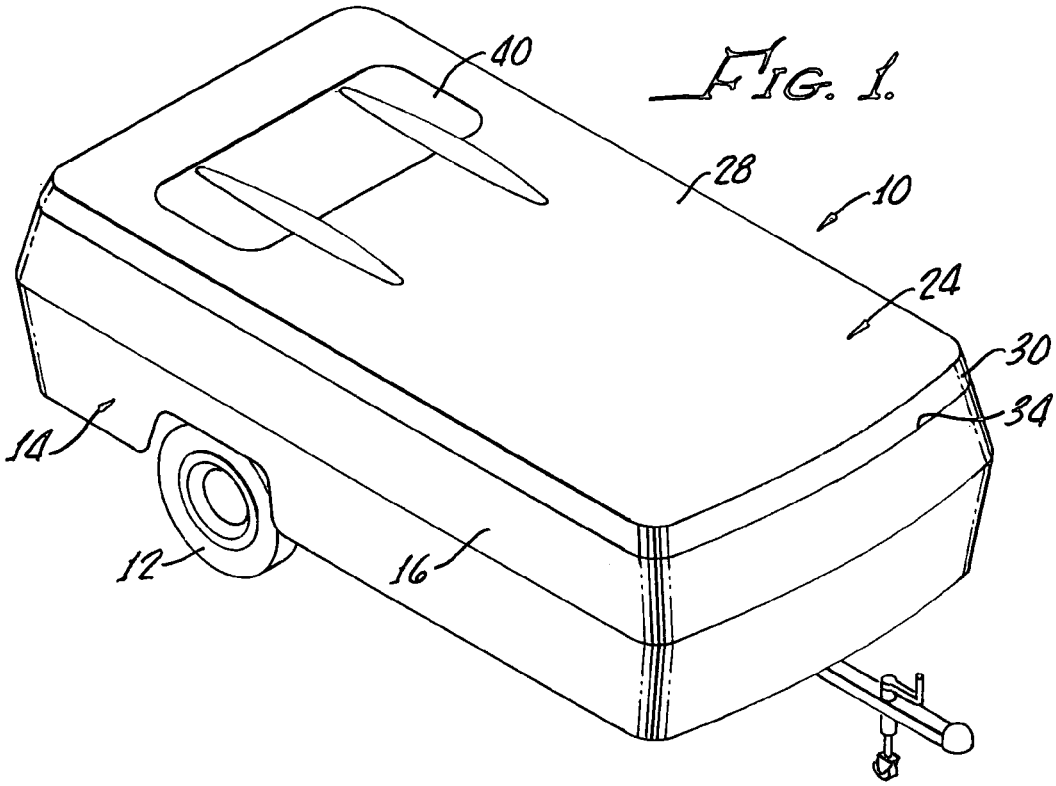
FIG. 1 is a perspective view of a vehicle and closure in accordance with the present invention generally showing a wheeled frame, sidewalls, and a top, with the top being illustrated in a closed position.
Figure 2:
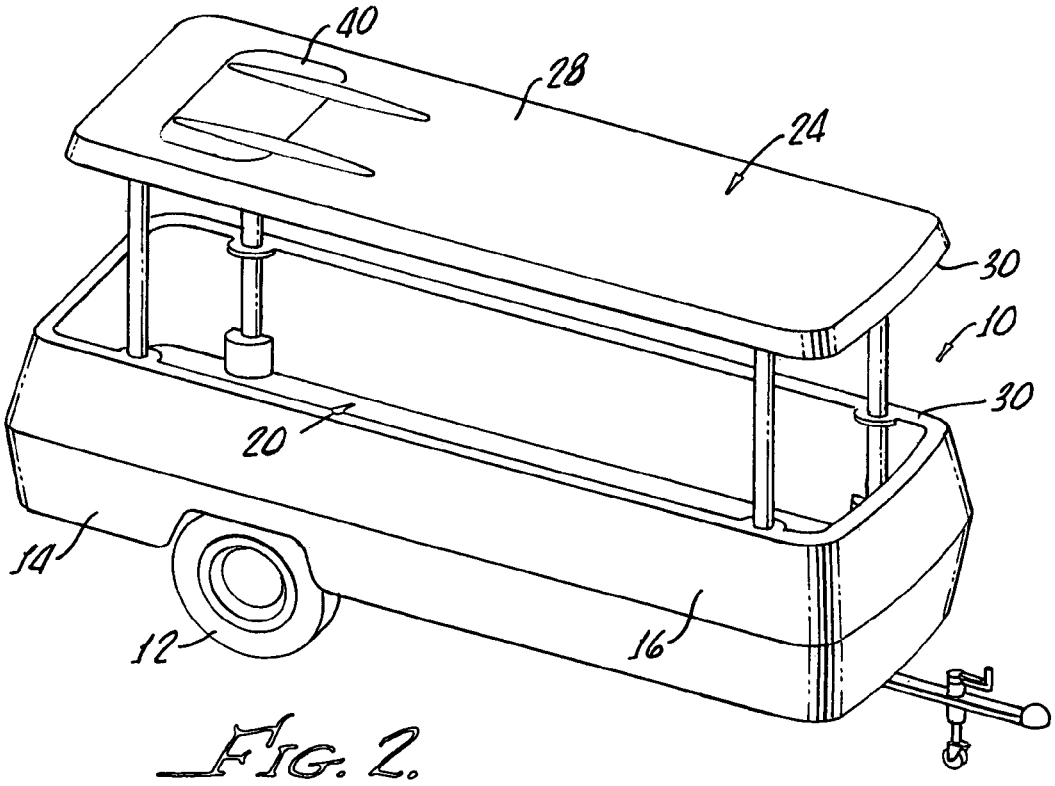
FIG. 2 is a view similar to FIG. 1 with the top in a open position.

With reference to FIGS. 1-3, there is shown a vehicle 10 in accordance with the present invention generally including a wheeled 12 frame 14 and topsides 16 with a cargo/living space area 20 therein. A closure 24 is provided which includes a top 28 having a perimeter 30 for engaging a topsides perimeter 34 in a closed position, as shown in FIGS. 1 and 3, and providing a shade canopy for the sidewalls 16, particularly the cargo/living area/space 20 when in an open position as shown in FIG. 2.

It should be appreciated that all of the components of the vehicle 10 and closure 24 may be constructed from common marine materials such as, for example, fiberglass, or the like.

A panel 40 may be movably attached to the top 28 for enabling entry and exit from the vehicle 10 with the top 28 in a closed position, as shown in FIG. 3, by an access 42 through the top 28 provided by the panel 40 in the open position, as shown in FIG. 3.

The panel 40 may be attached to the top 28 as hereinafter discussed and may utilized slides 46, 48 enabling movement as indicated by the arrow 52 between a closed position shown in FIG. 2 and an open position shown in FIG. 3.

Figures 4, 5, 6:
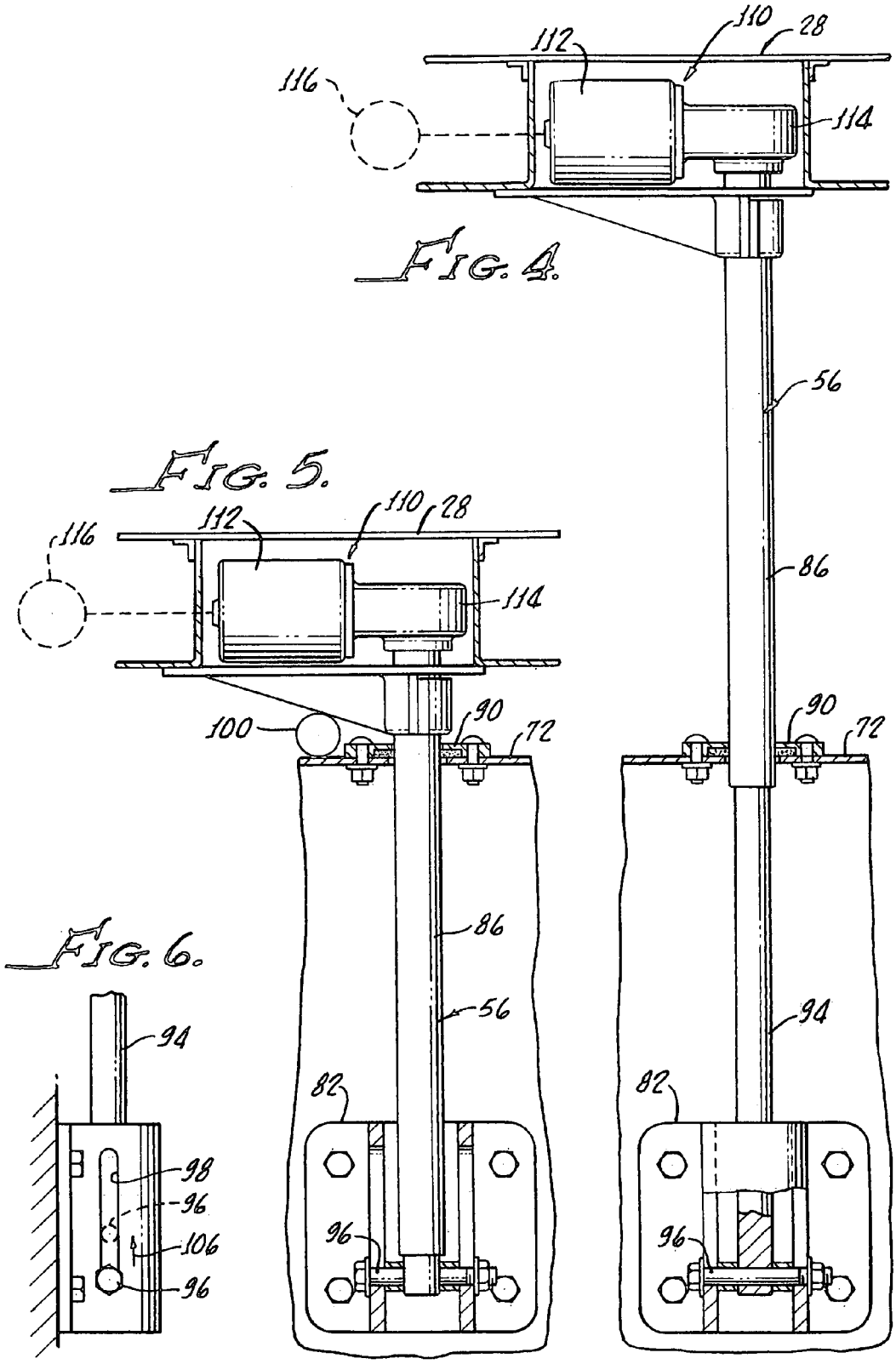
FIG. 4 is an enlarged view of actuators for moving the top between the open and closed positions along with a motor mechanism for operating the actuators, the actuators being extended with the top shown in an open position.
FIG. 5 is a view similar to that shown in FIG. 4 with the actuators in a retracted position and the top in a closed position.
FIG. 6 is a side view of a compliant fixture for reducing pressure on an object which may be inadvertently placed between the sidewall and the top during closure of the top which includes a slot, as shown in conjunction with a cross bar member illustrated in FIGS. 4 and 5.

With references to FIGS. 2, 4, and 5, linear actuators 56, 58, 60, 62 are provided for moving the top 28 between the open and closed positions. Interconnection between the top 28 and inboard portions 72, 74, 76, 78, is best shown in FIGS. 4 and 5. The linear actuators 56, 58, 60, 62 may be of a conventional type and are affixed to the sidewalls 12 through the use of compliant fixtures 82, only one being shown for clarity.

Stabilization of upper portions 86 of the actuator 56 is provided by bushings 90 fitted to the inboard portions 72 while a lower portion 94 of the actuator 56 is attached via a cross bar 96 in a slot 98 in the fixture 82, as best shown in FIG. 6.

This arrangement provides a safety feature by reducing pressure on an object 100, see FIG. 5, upon lowering of the top 28, as indicated by the arrow 102 in FIG. 5. Such an object 100, which may be, for example, a piece of equipment or operator's limb, causes the actuator 56 to lift in the slot 98, as indicated by the arrow 106 and cross bar 96, as indicated in dash line. Thus, the fixture 82 provides for compliance to reduce any damage or harm to the top 28 or object 100.

The linear actuator 56, 58, 60, 62 are operated by a motor mechanism 110 disposed in a conventional operative relationship therewith utilizing a motor 112 and gear box 114.

It should be appreciated that a motor mechanism 110 is provided for each actuator 56, 58, 60, 62 within the top 28, only one being shown for clarity, all other motor mechanisms being identical.

A control system 116 shown in dashed line in FIGS. 4 and 5 is provided for driving the motors 112 and actuator 56 in a manner preventing torquing of the top 28. Such torquing may occur if the motors do not drive the actuators 56, 58, 60, 62 in a coordinated manner. That is, if one of the actuators 56, 58, 60, 62 operates faster than another, twisting the top may occur. This is accomplished by including conventional circuitry in the controller 116 for monitoring the current drawn by each of the motors in operation thereby insuring coordinated movement of the actuators 56, 58, 60, 62 in both raising and lowering the top 28.

With reference to FIG. 7, showing a cross section of the panel 40, a seal is provided around the cargo/living area 20 by grooves 120, 122 formed in the sidewalls 16 sized for receiving ridges 124, 126 in an underside 130 of the panel 40.

In order to enable the panel 40 to be moved forward along the slides 46, 48, see also FIG. 8, a lift mechanism 130 is provided which includes a lever 134 pivotally attached to a bracket 136.

In operation, the lever is moved upward, as indicated by the arrow 140 thereby disengaging the ridges 124, 126 from the grooves 120, 122, as indicated in phantom line in FIG. 7. Thereafter, the panel 40 may be slit forward along the slides 46, 48, as indicated by the arrow 52 in FIGS. 3 and 9.

Although there has been hereinabove described a specific vehicle and closed system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A vehicle comprising:

a wheeled frame;

sidewalls with a cargo/living space therebetween;

a top having a perimeter contoured for engaging a sidewall perimeter in a closed position and providing a canopy for the cargo/living space in an open position, said top sealing said sidewalls in the closed position;

linear actuators for moving the top between the open and closed positions, each actuator is attached to the sidewalls with a compliant fixture for reducing pressure on an object placed between said sidewalls and top upon contact therewith during movement of said top the closed position; and a plurality of motors for operating said linear actuators each motor being disposed in an operative relationship with a corresponding actuator.

2. The vehicle according to claim 1 wherein each compliant fixture includes a slotted bracket and each actuator includes a cross bar slidably retained in a corresponding slot.

3. The vehicle according to claim 2 further comprising a control system for driving said motors and actuators in a manner preventing torquing of said top.

4. A closure for a vehicle having sidewalls, said closure comprising:

a moveable top having a perimeter contoured for engaging the sidewalls for sealing said sidewalls in a closed position and providing a canopy for the cargo/living space in an open position;

an actuator mechanism for moving the top between the open and closed positions, said actuator mechanism including a plurality of linear actuators interconnected between the sidewalls and the top, each actuator being attached the sidewalls with a compliant fixture for reducing pressure on a object placed between said sidewalls and top upon contact therewith during movement of said top to the closed position, said actuator mechanism including a plurality of motors disposed in said top, each motor being disposed in an operative relationship with a corresponding linear actuator; and a panel moveably attached to the top for enabling operator entry and exit to and from said vehicle with the top in said closed position through an access provided by said panel.

5. The closure according to claim 4 wherein each compliant fixture includes a slotted bracket and each actuator includes a cross bar slidably retained in a corresponding slot.

6. The closure according to claim 5 further comprising a control system for driving said motors and actuators in a manner preventing torquing of said top.

* * * * *